US008652728B2

(12) United States Patent
Mine et al.

(10) Patent No.: US 8,652,728 B2
(45) Date of Patent: Feb. 18, 2014

(54) TONER FOR ELECTROSTATIC LATENT IMAGE DEVELOPMENT AND PRODUCTION METHOD THEREOF

(75) Inventors: Tomoko Mine, Tokyo (JP); Mikihiko Sukeno, Hyogo (JP); Hajime Tadokoro, Kanagawa (JP); Ken Ohmura, Tokyo (JP); Tatsuya Nagase, Tokyo (JP); Tomomi Oshiba, Tokyo (JP); Saburou Hiraoka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 23 days.

(21) Appl. No.: 13/271,477

(22) Filed: Oct. 12, 2011

(65) Prior Publication Data

US 2012/0094229 A1 Apr. 19, 2012

(30) Foreign Application Priority Data

Oct. 18, 2010 (JP) ..... 2010-233439

(51) Int. Cl.
*G03G 9/00* (2006.01)

(52) U.S. Cl.
USPC ..... 430/109.3; 430/109.1; 430/109.4

(58) Field of Classification Search
USPC ..... 430/108.1, 109.1, 109.3, 109.4
See application file for complete search history.

(56) References Cited

U.S. PATENT DOCUMENTS

| | | | | |
|---|---|---|---|---|
| 5,948,584 | A * | 9/1999 | Hashimoto et al. | 430/109.3 |
| 2009/0274972 | A1* | 11/2009 | Sato et al. | 430/108.2 |
| 2010/0047706 | A1* | 2/2010 | Matsumura et al. | 430/108.4 |

FOREIGN PATENT DOCUMENTS

| | | |
|---|---|---|
| CN | 1573580 | 2/2005 |
| CN | 101546139 | 9/2009 |
| JP | 2007-057823 | 3/2007 |
| JP | 2010-055093 | 3/2010 |

OTHER PUBLICATIONS

SIPO Office Action, Application No. 201110319967.2, Issue Date: Sep. 28, 2012.
English translation of SIPO Office Action, Application No. 201110319967.2, Issue Date: Sep. 28, 2012.

* cited by examiner

*Primary Examiner* — Stewart Fraser
(74) *Attorney, Agent, or Firm* — Lucas & Mercanti, LLP

(57) ABSTRACT

A toner comprising toner particles containing a binder resin comprising a crystalline polyester resin, a non-crystalline polyester resin and an acryl resin having a cross-link structure, and the acryl resin having a cross-link structure has a cross-link site derived from a crosslinking agent represented by the following formula (1):

$$CH_2{=}CR^1{-}C({=}O)O{-}Z{-}OC({=}O){-}CR^2{=}CH_2 \quad \text{Formula (1)}$$

wherein $R^1$ and $R^2$ are each a hydrogen atom or an alkyl group of 1 to 3 carbon atoms, and Z is a hydrocarbon group of 2 to 90 carbon atoms, provided that the hydrocarbon group may include an ether linkage, an ester linkage, a heterocyclic ring or a substituent.

17 Claims, No Drawings

TONER FOR ELECTROSTATIC LATENT IMAGE DEVELOPMENT AND PRODUCTION METHOD THEREOF

This application claims priority from Japanese Patent Application No. 2010-233439, filed on Oct. 18, 2010, which is incorporated hereinto by reference.

FIELD OF THE INVENTION

The present invention relates to a toner for an electrostatic latent image development for use in electrophotographic image formation (hereinafter, also denoted simply as a toner) and a production method of the toner.

BACKGROUND OF THE INVENTION

Recently, in response to the requirement for high-quality imaging from the market, development of an electrophotographic toner suitable therefor has been promoted and there has been known, as such a toner, a polymerization toner which exhibits a narrow particle size distribution and enhanced reproducibility of minute dots and is produced by a process of emulsion polymerization and aggregation.

Meanwhile, to achieve energy saving, speed-up and space saving of an image forming apparatus, a toner with enhanced low-temperature fixability has been desired and to obtain such a toner, there is known a technique of lowering the melting point or fusion viscosity of a binder resin by use of a crystalline polyester resin. However, there were produced problems that such a toner resulted in lowering of mechanical strength (for example, stress resistance) or high-temperature off-set resistance.

As an invention to achieve both low temperature fixability and mechanical strength, for example, there was disclosed a polymerization toner comprised of multi-layered resin particles formed of layers of a crystalline polyester resin, a non-crystalline polyester resin and a crystalline polyester resin, as described in, for example, Patent document 1.

However, the foregoing polymerization toner produced problems that phenomena such as high-temperature offset.

To overcome such problems, there was proposed a toner comprised of a binder resin including a crystalline polyester resin, a non-crystalline polyester resin and an acryl resin having a cross-link structure (as described in, for example, Patent document 2). Such a toner, in which such an acryl resin having a cross-link structure acts as a high-elastic component, can achieve excellent high-temperature offset resistance, while maintaining low temperature fixability by the crystalline polyester resin.

However, the foregoing toner, in which the acryl resin having a cross-link structure was formed by use of a cross-linking agent of divinylbenzene, produced problems such that the achieved mechanical strength was low, that is, being fragile, resulting in image defects in the formed image.

Patent Document:

JP 2007-057823 A

JP 2010-055093 A

SUMMARY OF THE INVENTION

The present invention has come into being in light of the foregoing circumstances and it is an object of the present invention to provide a toner for electrostatic latent image development which is capable of basically forming images of enhanced image quality and achieves enhanced high temperature offset resistance and mechanical strength, while maintaining superior low-temperature fixability, and a production method thereof.

One aspect of the present invention is directed to a toner comprising toner particles containing a binder resin comprising a non-crystalline polyester resin, a crystalline polyester resin and an acryl resin having a cross-link structure, and the acryl resin having a cross-link structure having a cross-link site derived from a crosslinking agent represented by the following formula (1):

$$CH_2{=}CR^1{-}C({=}O)O{-}Z{-}OC({=}O){-}CR^2{=}CH_2 \qquad \text{Formula (1)}$$

wherein $R^1$ and $R^2$ are each a hydrogen atom or an alkyl group of 1 to 3 carbon atoms, and Z is a hydrocarbon group of 2 to 90 carbon atoms, provided that the hydrocarbon group may include an ether linkage, an ester linkage, a heterocyclic ring or a substituent.

In the toner particles of the toner of the present invention, the content of a tetrahydrofuran-insoluble component derived from the binder resin is preferably from 1 to 50% by mass.

In the toner particles of the toner of the present invention, the content of a tetrahydrofuran-insoluble component derived from the acryl resin is preferably from 1 to 100% by mass of the tetrahydrofuran-insoluble component derived from the binder resin. A production method of a toner comprising toner particles comprising a binder resin composed of a non-crystalline polyester resin, a crystalline polyester resin and an acryl resin having a cross-link structure, the method comprising the steps of:

dispersing an oil-phase solution containing an acrylic polymerizable monomer and a cross-linking agent in an aqueous medium to form a dispersion and then subjecting the dispersion to polymerization to form cross-linked acrylic resin particles comprised of an acrylic resin having a cross-link structure, and allowing non-crystalline polyester resin particles comprised of a non-crystalline polyester resin, crystalline polyester resin particles comprised of a crystalline polyester resin and the cross-linked acrylic resin particles to be aggregated and fused to form toner particles, wherein the cross-linking agent to form cross-linked acrylic resin particles is represented by the following formula (1):

$$CH_2{=}CR^1{-}C({=}O)O{-}Z{-}OC({=}O){-}CR^2{=}CH_2 \qquad \text{Formula (1)}$$

wherein $R^1$ and $R^2$ are each a hydrogen atom or an alkyl group of 1 to 3 carbon atoms, and Z is a hydrocarbon group of 2 to 90 carbon atoms, provided that the hydrocarbon group may include an ether linkage, an ester linkage, a heterocyclic ring or a substituent.

In the production method of toner particles of the present invention, the content of a tetrahydrofuran-insoluble component derived from the binder resin is preferably from 1 to 50% by mass.

In the production method of toner particles of the present invention, the content of a tetrahydrofuran-insoluble component derived from the acryl resin is preferably from 1 to 100% by mass of the tetrahydrofuran-insoluble component derived from the binder resin.

The toner of the present invention can form images of enhanced image quality and achieve enhanced resistance to high temperature offset with maintaining low temperature fixability and superior mechanical strength. The reason for achieving superior mechanical strength by using the toner of the present invention is presumed to be that a cross-link site derived from a specific cross-linking agent is contained, that is, a long chain portion of a specific cross-linking agent is introduced and flexibility is provided by the long chain portion.

The foregoing toner can be produced according to the method of producing the toner of the present invention. It is presumed that, in the production method of the present invention, the action of a specific cross-linking agent achieves enhanced affinity and compatibility of an acryl resin to a crystalline polyester resin and a non-crystalline polyester resin, whereby sufficient progress of reaction is assured, leading to reduced load in production.

DETAILED DESCRIPTION OF THE INVENTION

In the following, the present invention will be described in detail.

Production Method of Toner:

In the present invention, the method of producing a toner comprises the steps of forming cross-linked acryl resin particles composed of an aryl resin having a cross-link structure (which is hereinafter also denoted as crosslinked acryl resin) by performing polymerization with dispersing, in an aqueous medium, an oil-phase solution containing at least an acrylic polymerizable monomer and a specific crosslinking agent containing a long chain portion; and causing non-crystalline polyester resin particles composed of a non-crystalline polyester resin, crystalline polyester resin particles composed of a crystalline polyester resin and the cross-linked acrylic resin particles to be aggregated and fused to form toner particles.

The specific crosslinking agent used in the production method of the toner of the present invention is a compound represented by the foregoing formula (1). In the formula (1), $R^1$ and $R^2$ are each a hydrogen atom or an alkyl group of 1 to 3 carbon atoms. "Z" is a hydrocarbon group of 2 to 90 carbon atoms, provided that the hydrocarbon group may include an ether linkage, an ester linkage, a heterocyclic ring or a substituent. The hydrocarbon group constituting "Z" may be any form of a straight chain, a branched chain or a cycle, or may be one having an unsaturated bond.

Specific examples of such a crosslinking agent are shown below:

(1) Diacrylate Compound:

1,4-butanediol diacrylate, 1,3-butylene glycol diacrylate, 1,5-pentanediol diacrylate, 1,6-hexanediol diacrylate, neopentyl glycol diacrylate, 1,9-nonanediol neopentyl glycol diacrylate, 1,10-decanediol diacrylate, 1,12-dodecanediol diacrylate, pentaerythritol diacrylate, trimethylolethane diacrylate, trimethylolpropane diacrylate, 2-hydroxy-3-acryloyloxypropyl methacrylate, polyethylene glycol diacrylate, propoxylated ethoxylated bisphenol A diacrylate, ethoxylated bisphenol A diacrylate, 9,9-bis[4-(2-acryloyloxyethoxy)phenyl]fluorene, propoxylated bisphenol A diacrylate, tricyclodecane dimethanol diacrylate, 1,10-decanediol diacrylate, dipropylene glycol diacrylate, tripropylene glycol diacrylate, polypropylene glycol diacrylate, and polytetramethylene glycol diacrylate;

(2) Dimethacrylate Compound:

1,4-butanediol dimethacrylate, 1,3-butylene glycol dimethacrylate, 1,5-pentanediol dimethacrylate, 1,6-hexanediol dimethacrylate, neopentyl glycol dimethacrylate, 1,9-nonanediol neopentyl glycol dimethacrylate, 1,10-decanediol dimethacrylate, 1,12-dodecanediol dimethacrylate, pentaerythritol dimethacrylate, trimethylolethane dimethacrylate, trimethylolpropane dimethacrylate, ethylene glycol dimethacrylate, diethylene glycol dimethacrylate, triethylene glycol dimethacrylate, polyethylene glycol dimethacrylate, ethoxylated Bisphenol A dimethacrylate, tricyclodecane dimethanol dimethacrylate, ethoxylated polypropylene glycol dimethacrylate, glycerin dimethacrylate, and polypropylene glycol dimethacrylate;

(3) Tri(meth)acrylate Compound:

pentaerythritol triacrylate, trimethylolethane triacrylate, trimethylolpropane triacrylate, pentaerythritol trimethacrylate, trimethylolethane trimethacrylate, trimethylolpropane trimethacrylate, ethoxylated isocyanuric acid triacrylate, ϵ-caprolactone-modified tris-(2-acryloyloxyethyl)isocyanurate, and ethoxylated glycerine triacrylate;

(4) Tetra(meth)acrylate Compound:

pentaerythritol tetraacrylate, trimethylolethane tetraacrylate, N,N,N',N'-tetrakis(β-hydroxyethyl)ethylenediamine acrylic acid ester, N,N,N',N'-tetrakis(β-hydroxyethyl)ethylenediamine methacrylic acid ester, di-trimethylolpropane tetraacrylate, and ethoxylated pentaerythritol tetraacrylate;

(5) Hexa(meth)acrylate Compound:

dipentaerythritol hexaacrylate, and dipentaerythritol hexamethacrylate.

A specific example of the production method of a toner of the present invention is shown below. The method comprises the steps of:

(1-A) preparation of a crystalline polyester resin particle dispersion, in which a crystalline polyester resin is synthesized and a dispersion of particles of the crystalline polyester resin (hereinafter, also denoted as crystalline polyester resin particle dispersion) is prepared;

(1-B) preparation of a non-crystalline polyester resin particle dispersion, in which a non-crystalline polyester resin is synthesized and dissolved or dispersed in an organic solvent to prepare an oil-phase solution, and the oil-phase solution is dispersed in an aqueous medium to form oil droplets of the oil-phase solution, followed by removal of the organic solvent to prepare a dispersion of particles of the non-crystalline polyester resin (hereinafter, also denoted as non-crystalline polyester resin particle dispersion);

(1-C) preparation of a crosslinked acryl resin particle dispersion, in which an oil-phase solution containing at least a polymerizable acrylic monomer and a specific crosslinking agent is dispersed in an aqueous medium to form a dispersion and the dispersion is subjected to polymerization to form crosslinked acryl resin particles comprised of an acryl resin having a cross-link structure; and optionally;

(1-D) preparation of a colorant particle dispersion, in which colorant particles are dispersed in an aqueous medium to form a colorant particle dispersion;

(2) aggregation and fusion, in which non-crystalline polyester resin particles, crystalline polyester resin particles, crosslinked acryl resin particles and optionally toner constituent particles, such as colorant particles, releasing agent particles or charge-controlling agent particles, are allowed to aggregate or fuse in an aqueous medium to form toner particles;

(3) filtration and washing, in which the thus prepared toner particles are filtered off from the aqueous medium and washed to remove any surfactant or the like;

(4) drying the thus washed toner particles, and optionally, (5) addition of external additives, in which external additives are added to the thus dried toner particles.

(1-A) Preparation of Crystalline Polyester Resin Particle Dispersion:

In the step of preparation of a crystalline polyester resin particle dispersion, a crystalline polyester resin which constitutes a material used for a binder resin constituting toner particles, is synthesized and dispersed in an aqueous medium to prepare a crystalline polyester resin particle dispersion.

In the present invention, the crystalline polyester resin refers to a polyester resin which exhibits a definite endothermic peak, not a stepwise change of endothermic heat quantity. Such a crystalline polyester resin is not specifically limited and, for example, a resin having such a structure that a main chain of a crystalline polyester resin is co-polymerized with another component, also falls under the category of the crystalline polyester resin of the present invention.

A crystalline polyester resin usable in the present invention preferably exhibits a melting point falling within a range of 30 to 90° C., and more preferably 45 to 88° C.

The melting point of a crystalline polyester resin refers to the temperature at the endothermic peak, which is determined in differential scanning calorimetry using a differential colorimeter, DSC-7 (produced by Perkin Elmer Co.) and a thermal analysis controller, TAC7/DX (also produced by Perkin Elmer Inc.).

Specifically, 0.5 mg of a crystalline polyester resin is placed into an aluminum pan (kit No. 0219-0041), which is set to a sample holder DSC-7. Temperature control of Heat-Cool-Heat is performed at temperature-increasing rate of 10° C./min and a temperature-decreasing rate of 10° C./min within a measurement temperature range and analysis is made based on the data obtained in the 2nd "Heat". Reference measurement is performed using an empty aluminum pan.

A crystalline polyester resin usable in the present invention preferably exhibits a number average molecular weight (Mn) of 100 to 10,000, and more preferably 800 to 5,000, and a weight average molecular weight (Mw) of 1,000 to 50,000 and more preferably 2,000 to 30,000, which are determined by gel permeation chromatography (GPC) of a portion soluble in tetrahydrofuran (THF-soluble portion). When the weight average molecular weight (Mw) of a THF-soluble portion of a crystalline polyester resin is less than 1,000, the polyester is compatible with a non-crystalline polyester resin and the obtained toner particles exhibit a relatively low melting point and possibly result in deteriorated blocking resistance, while when it is more than 50,000, the toner particles could be deteriorated in low temperature fixability.

Determination of molecular weight by GPC is performed in the following manner. Using an apparatus, HLC-8220 (produced by TOSO Co., Ltd.) and a column, TSK guard column+TSK gel Super HZM-M three-stranded (produced by TOSO Co., Ltd.), tetrahydrofuran (THF) as a carrier solvent is allowed to flow at a flow rate of 0.2 ml/min, while maintaining a column temperature at 40° C. A binder resin is dissolved in tetrahydrofuran (THF) at room temperature, while being stirred over 5 min. by an ultrasonic homogenizer to obtain a solution at a concentration of 1 mg/ml. Subsequently, the solution is filtered with a membrane filter having a pore size of 0.2 μm to obtain a sample solution. Into the apparatus is injected 10 μl of the obtained sample solution together with the foregoing carrier solvent and detected by using a refractive index detector (RI detector). The molecular weight distribution of a sample is determined by use of a calibration curve which was prepared by using monodisperse polystyrene standard particles to determine the molecular weight. Standard polystyrene samples used for preparation of a calibration curve employ those of molecular weights of $6\times10^2$, $2.1\times10^3$, $4\times10^3$, $1.75\times10^4$, $5.1\times10^4$, $1.1\times10^6$, $3.9\times10^5$, $8.6\times10^5$, $2\times10^6$ and $4.48\times10^6$, produced by Pressure Chemical Co. A calibration curve is prepared using at least ten of these standard polystyrene samples. A refractive index detector is used as a detector.

A crystalline polyester resin can be formed of a dicarboxylic acid component and a diol component.

The dicarboxylic acid component preferably is an aliphatic dicarboxylic acid, which may be used in combination with an aromatic dicarboxylic acid. Such a dicarboxylic acid component is not limited to a single acid but two or more acids may be mixedly used.

Specific examples of an aliphatic dicarboxylic acid include oxalic acid, malonic acid, succinic acid, glutaric acid, glutaric acid, adipic acid, pimelic acid, suberic acid, sebacic acid, 1,9-nonanedicarboxylic acid, azelaic acid, 1,10-decanedicarboxylic acid, 1,11-undecanedicarboxylic acid, 1,12-undecanedicarboxylic acid, 1,13-tridecanedicarboxylic acid, 1,14-tetracanedicarboxylic acid, 1,16-hexadecanedicarboxylic acid, and 1,18-octadecanedicarboxylic acid, and lower alkyl esters or acid anhydrides of these acids may be used. Of the foregoing aliphatic dicarboxylic acids, adipic acid, sebacic acid and 1,10-decanedicarboxylic acid are preferred in terms of availability.

Aromatic carboxylic acids which are usable with an aliphatic carboxylic acid include, for example, terephthalic acid, isophthalic acid, orthophthalic acid, t-butylisophthalic acid, 2,6-naphthalene-dicarboxylic acid, and 4,4'-biphenyldicarboxylic acid. Of these acids, terephthalic acid, isophthalic acid, and t-butylisophthalic acid are preferred in terms of availability and emulsibility.

The amount of an aromatic dicarboxylic acid to be used is preferably not more than 20 mol %, more preferably not more than 10 mol %, and still more preferably not more than 5 mol %, based on all of the dicarboxylic acids being 100 mol %. The use of an aromatic carboxylic acid of not more than 20 mol % can achieve crystallinity of a crystalline polyester resin and the produced toner can attain low temperature fixability, and the finally formed image can achieve enhanced glossiness and inhibit a lowering of image storage stability due to melting-point lowering. Further, when forming oil-droplets by using an oil phase solution containing the foregoing crystalline polyester resin, an emulsified state can be definitely attained.

The diol component preferably is an aliphatic diol, which may be used in combination with a diol other than an aliphatic diol.

Of aliphatic diols, a straight chained aliphatic diol having a main chain of 2 to 22 carbon atoms is preferably used, while a straight chained aliphatic diol having a main chain of 2 to 14 carbon atoms is specifically preferred in terms of availability, low-temperature fixability and formation of an image of high glossiness. When using a straight-chained aliphatic diol having a main chain of 2 to 22 carbon atoms, any polyester resin of a melting point at a level inhibiting low temperature fixability is not formed even when using an aromatic dicarboxylic acid in combination, the produced toner can achieve sufficient low-temperature fixability and a finally formed image can also achieve enhanced glossiness. A branched aliphatic diol may also be used, as a diol component, together with a straight chain aliphatic diol, in which it is preferred to use such a straight chain aliphatic diol at a relatively high ratio, whereby enhanced crystallinity is achieved, the produced toner securely achieves superior low temperature fixability and a lowering of image storage stability, due to lowering of the melting point is inhibited in the finally formed image and blocking resistance is also achieved. A diol component is not limited to a single diol and plural diols may be used in combination.

The content of an aliphatic diol as a diol to form a crystalline polyester resin is preferably not less than 80 mol %, and more preferably not less than 90 mol %. An aliphatic diol content of not less than 80 mol % of diol components can achieve crystallinity of the crystalline polyester resin, whereby the produced toner can achieve sufficient low-temperature fixability and a finally formed image can also achieve enhanced glossiness.

Specific examples of an aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol1,13-tridecanediol, 1,14-tetradecanediol, 1,18-octadecanediol, and 1,20-eicosanediol. Of these are preferred ethylene glycol1,4-butanediol, 1,6-hexanediol, 1,9-nonanediol and 1,10-decanediol.

Diols other than an aliphatic diol include a diol having a double bond and a diol having a sulfonic acid group. Specific examples of a diol having a double bond include 2-butene-1,4-diol, 3-hexene-1,6-diol and 4-octene-1,8-diol. The content of a diol having a double bond is preferably not more than 20 mol % of diol components, and more preferably 2 to 10 mol %. When the content of a diol having a double bond is not more than 20 mol %, the melting point of the obtained polyester resin is not greatly lowered and accordingly, concern of occurrence of filming is reduced.

The ratio of a diol component to a dicarboxylic acid component is preferably from 1.5/1 to 1/1.5 in terms of equivalent weight ratio of a hydroxyl group of a diol component [OH] to a carboxyl group of a dicarboxylic acid component [COOH], i.e., [OH]/[COOH] is preferably from 1.5/1 to 1/1.5, and more preferably from 1.2/1 to 1/1.2. When using the ratio of a diol component to a dicarboxylic acid component falling within the foregoing range, a crystalline polyester resin of an intended molecular weight can be securely obtained.

The foregoing crystalline polyester resin is dispersed in an aqueous medium in such a manner that the crystalline polyester resin is dissolved or dispersed in an organic solvent to prepare an oil-phase solution and the oil-phase solution is dispersed in an aqueous medium by emulsion phase inversion and after forming oil droplets controlled to intended sizes, an organic solvent is removed.

In the present invention, the expression, "aqueous medium" refers to a medium containing at least 50% by mass water and as a component other than water are cited water-soluble organic solvent and examples thereof include methanol ethanol, isopropanol, butanol, acetone, methyl ethyl ketone, dimethyl formamide, methyl cellosolve, and tetrahydrofuran. Of these, alcoholic solvents such as methanol, ethanol, isopropanol and butanol are preferably used as an organic solvent which does not dissolve a resin.

An aqueous medium is used preferably in an amount of 50 to 2,000 parts by mass, based on 100 parts by mass of an oil phase solution, and more preferably, 100 to 1,000 parts by mass. An oil-phase solution can be dispersed in an aqueous medium at an intended particle size by use of an aqueous medium in an amount falling within the foregoing range.

A dispersion stabilizer may be dissolved in an aqueous medium, and a surfactant or resin particles may be added to the aqueous medium to achieve enhanced dispersion stability of oil droplets.

Examples of a dispersion stabilizer include inorganic compounds such as tri-calcium phosphate, calcium carbonate, titanium oxide, colloidal silica, and hydroxyapatite, and an acid- or alkali-soluble compound such as tri-calcium phosphate is preferable from necessity of removal of a dispersion stabilizer from the obtained toner parent particles, and, from environmental point of view, it is also preferable to use a dispersion stabilizer which is readily decomposable by an enzyme.

Specific examples of a surfactant include anionic surfactants such as an alkylbenzene sulfonate, α-olefinsulfonate and a phosphoric acid ester; amine salt type cationic surfactants such as an alkylamine salt, aminoalcohol carboxylic acid derivatives, polyamine carboxylic acid derivatives and imidazolone, and quaternary ammonium salt type cationic surfactants such as an alkyltrimethylammonium, a dialkyldimethylammonium, alkyl-dimethylbenzylammonium, a pyridimum salt, an alkylisoquinolinium salt andbemzetonium chloride; nonionic surfactants such as carboxylic acid amide derivatives and polyvalent alcohol derivatives; and amphoteric surfactants such as alaninedodecyldi(aminoethyl)glycine, di(octylaminoethyl)glycine and N-alkyl-N,N-dimethylammonium betaine. There are also usable a fluoroalkyl-containing anionic surfactant or cationic surfactant.

Resin particles to achieve enhanced dispersion stability preferably ones having 0.5 to 3 μm particle size. Specific examples thereof include 0.5 to 3 μm poly(methyl methacrylate) particles, 0.5 to 2 styrene resin particles and approximately 1 μm poly(styrene-acrylonitrile) resin particles.

An organic solvent for use in preparation of an oil-phase solution is preferably one which exhibits a low boiling point and is low-soluble in water, and includes, for example, methyl acetate, ethyl acetate, methyl ethyl ketone, methyl isobutyl ketone, toluene and xylene. These solvents may be used singly or in their combination. The amount of an organic solvent to be used is usually within a range of 1 to 300 parts by mass, based on 100 parts by mass of crystalline polyester resin, preferably 1 to 100 parts by mass and more preferably 25 to 70 parts by mass.

Emulsifying a dispersion of an oil-phase solution can be conducted by employing mechanical energy and dispersing machines to perform emulsifying dispersion are specifically limited and examples thereof include a low-speed shearing disperser, a high-speed shearing disperser, a friction type disperser, a high-pressure jet disperser and an ultrasonic disperser. The dispersed oil droplet size is preferably within the range of 60 to 1000 nm and more preferably 80 to 500 nm. The dispersed oil droplet size is a volume-based median diameter which is measured by using a laser diffraction/scattering type particle size distribution measurement device (LA-750, produced by Horiba Seisakusho Co., Ltd.). The dispersed oil droplet size can be controlled by mechanical energy when performing emulsifying dispersion.

Removal of an organic solvent after forming oil droplets can be carried out in the manner that the whole of the dispersion in which toner particles are dispersed in an aqueous medium is gradually heated with stirring in a laminar flow and is subjected to strong stirring within a prescribed temperature range and then, removal of the solvent is conducted. In cases when forming toner particles by using a dispersion stabilizer, in addition to the foregoing removal of an organic solvent, an acid or an alkali is added thereto and mixed to perform removal of the dispersion stabilizer.

(1-B) Preparation of Non-Crystalline Polyester Resin Particle Dispersion:

The step of preparing a non-crystalline polyester resin particle dispersion is a stage in which a non-crystalline polyester resin as a binder resin constituting toner particles is synthesized and the non-crystalline polyester resin is dispersed in an aqueous medium in a particulate form to prepare a non-crystalline polyester resin particle dispersion.

In the present invention, the non-crystalline polyester resin refers to a polyester resin other than the foregoing crystalline polyester resin, not exhibiting a melting point but exhibiting a relatively high glass transition temperature (Tg).

A non-crystalline polyester resin can be synthesized by using a polyvalent alcohol and a polyvalent carboxylic acid in the manner similar to the above-described synthesis of a crystalline polyester resin.

A non-crystalline polyester resin preferably exhibits a glass transition temperature (Tg) of 20 to 90° C., and more preferably 35 to 65° C. The softening point of a non-crystalline polyester resin preferably is in a range of 80 to 220° C., and more preferably 80 to 150° C. The glass transition point temperature (Tg) can be measured using a DSC-7 differential scanning colorimeter (produced by Perkin-Elmer Corp.) or TAC7/DX thermal analysis controller (produced by Perkin-Elmer Corp.). The measurement is conducted as follows. A binder resin of 4.5 to 5.0 mg is precisely weighed to two places of decimals, sealed into an aluminum pan (KIT No. 0219-0041) and set into a DSC-7 sample holder. An empty aluminum pan is used as a reference. The temperature is controlled through heating-cooling-heating at a temperature-raising rate of 10° C./min and a temperature-lowering rate of 10° C./min in the range of 0 to 200° C. An extension line from the base-line prior to the initial rise of the first endothermic peak and a tangent line exhibiting the maximum slope between the initial rise and the peak are drawn and the intersection of both lines is defined as the glass transition point.

The softening temperature (Tsp) of a binder resin can be determined in the following manner. Under an environment of 20° C. and 50% RH, 1.1 g of a binder resin are placed into a petri dish and leveled off. After being allowed to stand for at least 12 hrs., they are compressed for 30 sec. under a force of 3820 kg/cm$^2$ using a molding device SSP-A (produced by Shimazu Seisakusho) to prepare a cylindrical molded sample of a 1 cm diameter.

Using a flow tester CFT-500D (produced by Shimazu Seisakusho) under an environment of 24±5° C. and 50±20%, the prepared sample was extruded through a cylindrical die using a piston of 1 cm diameter after completion of pre-heating under conditions of a load weight of 196 N (29 kgF), at an initial temperature of 60° C., a pre-heating time of 300 sec. and temperature-raising rate of 6° C./min. An offset method temperature (also denoted as $T_{offset}$), which is determined at an offset value of 5 mm in a melting temperature measurement method (temperature-raising method), is defined as the softening point in the invention. The $T_{offset}$ refers to the temperature determined in the offset method.

In the non-crystalline polyester resin related to the present invention, the number average molecular weight (Mn), which is determined in gel permeation chromatography (GPC), is preferably within the range of from 2,000 to 10,000, and more preferably from 2,500 to 8,000; the weight average molecular weight (Mw) is preferably within the range of from 3,000 to 100,000, and more preferably from 4,000 to 70,000. When a weight average molecular weight (Mw) of a THF-soluble portion of a crystalline polyester resin is less than 3,000, the obtained toner is concerned to be inferior in blocking resistance; and when it is more than 100,000, the obtained toner is concerned to be inferior in low temperature fixability. The determination of molecular weight by GPC is conducted in the same manner as in the foregoing crystalline polyester resin, except that the THF-soluble portion of a non-crystalline polyester resin is used.

Examples of a polyvalent alcohol component to form a non-crystalline polyester resin include, in addition to the afore-described aliphatic diols, bisphenols such as Bisphenol A and Bisphenol F and addition compounds of an alkylene oxide such as ethylene oxide or propylene oxide to these bisphenols, and three or more polyhydric alcohols, such as glycerin, trimethylolpropane, pentaerythritol, sorbitol or the like, are also cited. Further, cyclohexane dimethyl or neopentyl alcohol is also preferably used in terms of production cost or environmental safety. Furthermore, as a polyvalent alcohol component to form a non-crystalline polyester resin are preferably usable 2-bututyne-1,4-diol, 3-butyne-1,4-diol and 9-octadecene-7,12-diol.

Examples of a polyvalent carboxylic acid component to from a non-crystalline polyester resin include, in addition to the afore-described aliphatic dicarboxylic acids, aromatic dicarboxylic acids such as phthalic acid, isophthalic acid, terephthalic acid and naphthalene-dicarboxylic acid. Further, to optimize the melt viscosity of the obtained non-crystalline polyester resin, there may be added a tri- or higher valent carboxylic acid such as trimellitic acid or pyromellitic acid. These may be used singly or in their combination.

There are also usable as a polyvalent carboxylic acid component to form a non-crystalline polyester resin, and include unsaturated carboxylic acids such as maleic acid, fumaric acid, itaconic acid, citraconic acid, glutaconic acid, isododecenylsuccinic acid, n-dodecenylsuccinic acid and octenylsuccinic acid, and their acid anhydrides and acid chlorides.

Further, a small amount of a monocarboxylic acid having a polymerizable unsaturated bond may be used in combination with a polyvalent carboxylic acid component to form a non-crystalline polyester resin.

Similarly to the case when dispersing a crystalline polyester resin in an aqueous medium, a non-crystalline polyester resin, as described above is also dispersed in an aqueous medium in such a manner that the non-crystalline polyester resin is dissolved or dispersed in an organic solvent to prepare an oil phase and after the oil phase is dispersed in an aqueous medium through phase inversion emulsification or the like to form oil droplets controlled to an intended size, followed by removal of the organic solvent. The sizes of thus dispersed oil droplets are preferably within a range of 60 to 1000 nm, and more preferably 80 to 5001 nm.

The size of dispersed oil droplets is a volume-based median diameter which is determined by using a laser diffraction/scattering type particle size distribution measurement apparatus (LA-750, produced by Horiba Seisakusho Co., Ltd.).

(1-C) Preparation of Crosslinked Acryl Resin Particle Dispersion:

In the stage of preparing a crosslinked acryl resin particle dispersion, a cross-linked acryl resin as a material used for a binder resin constituting toner particles is synthesized and a dispersion is prepared in which the cross-linked acryl resin is dispersed in the form of particles in an aqueous dispersion.

In the crosslinked acryl resin particles dispersed in the dispersion, a crosslinked acryl resin is prepared preferably through an emulsion polymerization method, in which an oil phase solution containing a polymerizable acrylic monomer and a specific cross-linking agent is dispersed in an aqueous medium and then, a radical polymerization initiator is added thereto to cause the polymerizable acrylic monomer to be polymerized in the presence of a specific crosslinking agent, whereby a particulate cross-linked acryl resin is formed.

Cross-linked acryl resin particles, each may be formed of two or more layers composed of resins differing in composition. Such resin particles can be prepared, for example, in the manner that, to a dispersion containing resin particles prepared according to the conventional emulsion polymerization process (first polymerization step), a polymerization initiator and a polymerizable monomer are added and subjected to a polymerization treatment (second polymerization step).

Examples of a polymerizable acrylic monomer to prepare an acrylic resin include methacrylic acid ester derivatives such as methyl methacrylate, ethyl methacrylate, isopropyl methacrylate, n-butyl methacrylate, isobutyl methacrylate, t-butyl methacrylate, n-octyl methacrylate, 2-ethylhexyl methacrylate, stearyl methacrylate, lauryl v, phenyl methacrylate, diethylaminoethyl methacrylate, and dimethylaminomethyl methacrylate; acrylic acid ester derivatives such as methyl acrylate, ethyl acrylate, isopropyl acrylate, n-butyl acrylate, isobutyl acrylate, t-butyl acrylate, n-octyl acrylate, 2-ethylhexyl acrylate, stearyl acrylate, lauryl acrylate, and phenyl acrylate. Of these are preferable butyl acrylate, 2-ethylhexyl acrylate and methyl methacrylate which are each a hydrophobic monomer, and acrylic acid and methacrylic acid which contain an ionic dissociative group. The foregoing monomers may be used singly or in combination of them.

A crosslinked acryl resin may be one which is copolymerized with a polymerizable styrene monomer. Examples of such a styrene monomer include styrene, o-methylstyrene, m-methylstyrene, p-methylstyrene, p-phenylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene, and their derivatives. Of these is preferred styrene, as a hydrophobic monomer. These may be used singly or in their combination.

In cases where a crosslinked acryl resin is one which has been copolymerized with a styrene monomer, the copolymerization ratio of polymerizable acryl monomer to polymerizable styrene monomer is preferably in the range of 80:20 to 10:90, based on mass. The thus defined copolymerization ratio can achieve a uniform copolymerization composition ratio.

The foregoing crosslinked acryl resin may be one which is obtained by copolymerization with a polymerizable monomer containing an ionically dissociative group. Specific examples of a polymerizable monomer containing an ionically dissociative group include maleic acid, itaconic acid, cinnamic acid, a maleic acid monoalkyl ester, an itaconic acid monoalkyl ester, styrene sulfonic acid, allylsulfosuccinic acid, 2-acrylamido-2-methylpropanesulfonic acid, acidophosphooxyethyl methacrylate, and 30chloro-2-acidophosphooxypropyl methacrylate.

A radical-polymerization initiator which is used for preparation of cross-linked acryl resin particles through an emulsion polymerization process can employ any water-soluble polymerization initiator. Specific examples thereof include a water-soluble azo-initiator such as 2,2'-azobis[2-(2-imidazoline-2-yl)propane dihydrochloride, 2,2'-azobis[2-(2-imidazoline-2-yl)propane disulfate anhydride, 2,2'-azobis(2-methylpropioneamidine)dihydrochloride, 2,2'-azobis[N-(2-carboxyethyl)-2-methylpropioneamidine]hydride, 2,2'-azobis{2-[1-]2-hydroxyethyl}-2-imidazoline-2-yl]propane dihydrochloride, 2,2'-azobis[2-(2-imidazoline-2-yl)propane], 2,2'-azobis(1-imino-1-pyrrolidino-2-ethylpropane)dihydrochloride, 2,2'-azobis{2-methyl-N[1,1-bis(hydroxymethyl)-2-hydroxyethyl]propioneamide}, and 2,2'-azobis[2-methyl-N-(2-hydroxyethyl)propioneamide]; a persulfate such as potassium persulfate and ammonium persulfate; azobisaminodipropane acetate, azobiscyanovalerianic acid and its salt, and hydrogen peroxide. These may be used singly or in their combination.

In the polymerization process to obtain cross-linked acryl resin particles, the reaction temperature is preferably not less than 60° C. and not more than 95° C.

In the process of synthesis of a cross-linked acryl resin, there are usable generally known chain-transfer agents to control the molecular weight of a cross-linked acryl resin. Examples of chain-transfer agents include a mercaptan such as 2-chloroethanol, octylmercaptan, dodecylmercaptan, and t-dodecylmercaptan; and a styrene dimer.

In the process of preparing a cross-linked acryl resin dispersion, the prepared cross-linked acryl resin preferably contains a tetrahydrofuran-insoluble component (which is a gelled component and hereinafter is also denoted simply as a THF-insoluble component) of 1 to 50% by mass. Such a THF-insoluble component of a cross-linked acryl resin indicates a content of a cross-liked component of toner particles. It is a concern that a content of less than 0.5% by mass cannot achieve enhanced high temperature offset resistance and it is also a concern that, when the content is more than 50% by mass, the progress of fusion in the process of preparing toner particles becomes slower, leading to an increased production load.

The foregoing THF-insoluble component can be determined can be determined in the manner that a given amount (for example, about 0.03 g) of a solid cross-linked acryl resin, as a measurement sample, is dipped in a given amount (approximately, 100 ml) of THF over 20 hours and then filtered off with a wire mesh, and the residual solid content is calculated in terms of mass percentage, base on the sample.

A cross-linked acryl resin formed in the process of preparing a cross-linked acryl resin dispersion preferably exhibits a weight-average molecular weight (also denoted simply as Mw) of not less than 50,000 and not more than 1,000,000 which is determined by subjecting a THF-soluble component to gel permeation chromatography (also denoted simply as GPC). When the weight-average molecular weight (Mw) of a THF-soluble component of a cross-linked acryl resin is less than 50,000, it is a concern that the obtained toner cannot achieve enhanced high temperature offset resistance, and when it is more than 1,000,000, it is also a concern that fixing is inhibited in the obtained toner. Determination of molecular weight by GPC is conducted in the same manner as the afore-described determination of molecular weight of a crystalline polyester resin, as afore-described, except that a THF-soluble component of a cross-linked acryl resin is used.

The glass transition temperature (Tg) of a cross-linked acryl resin is preferably from 20 to 120° C., and more preferably from 35 to 100° C. The softening point of a cross-linked acryl resin is preferably from 80 to 200° C., and more preferably from 110 to 180° C.

The glass transition temperature (Tg) and softening point of a cross-linked acryl resin is conducted in the same manner as the afore-mentioned glass transition temperature (Tg) and softening point of a non-crystalline polyester resin.

The average particle size of cross-linked acryl resin particles obtained in the step of preparing a cross-linked acryl resin particle dispersion is preferably from 50 to 400 nm in terms of volume-based median diameter, and more preferably from 80 to 200 nm. The volume-based median diameter of cross-linked acryl resin particles is determined by using an electrophoretic light-scattering photometer (ELS-800, produced by Otsuka Denshi Co., Ltd.).

(1-D) Preparation of a Colorant Particle Dispersion:

The step of preparing a colorant particle dispersion is one which is optionally conducted in cases when toner particles containing a colorant are desired and in which a colorant is in the form of fine particles dispersed in an aqueous medium to prepare a colorant particle dispersion.

A colorant can employ commonly known dyes and pigments. A colorant to obtain a black toner can employ, for example, a carbon black such as furnace black or channel black, a magnetic material such as magnetite or ferrite, a dye, and an inorganic pigment including a non-magnetic iron oxide. A colorant to obtain a color toner can employ commonly known dyes and organic pigments. Specific examples of an organic pigment include C.I. Pigment Red 5, C.I. Pigment Red 48:1, C.I. Pigment Red 53:1, C.I. Pigment Red 57:1, C.I. Pigment Red 81:4, C.I. Pigment Red 122, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, C.I. Pigment Red 238, C.I. Pigment Red 269; C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180 and C.I. Pigment Yellow 185; C.I. Pigment Orange 31 and C.I. Pigment Orange 43; C.I. Pigment Blue 15:3, C.I. Pigment Blue 60 and C.I. Pigment Blue 76. Examples of a dye include C.I. Solvent Red 1, C.I. Solvent Red 49, C.I. Solvent Red 52, C.I. Solvent Red 58, C.I. Solvent Red 68, C.I. Solvent Red 11, C.I. Solvent Red 122; C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98 and C.I. Solvent Yellow 95.

Colorants are used singly or in their combination to obtain the individual colors.

Dispersion of a colorant is conducted by employing mechanical energy. The thus dispersed colorant particles preferably exhibit a volume-based median diameter of 10 to 300 nm, more preferably 100 to 200 nm, and still more preferably 100 to 150 nm. The volume-based median diameter of colorant particles can be determined by using an electrophoretic light-scattering photometer (ELS-800, produced by Otsuka Denshi Co., Ltd.).

(2) Aggregation/Fusion Step:

In the aggregation and fusion step, a cross-liked acryloyl resin particle dispersion, a crystalline polyester resin particle dispersion and a non-crystalline polyester resin particle dispersion are mixed and further thereto, a colorant particle dispersion or a dispersion of toner particle constituents such as a releasing agent and a charge controlling agent is optionally added and mixed, and is gradually allowed to aggregate, while balancing the repulsion force of the particle surface with controlling the pH value and an aggregation force caused by addition of a flocculant to perform aggregation with controlling an aver age particle size and a particle size distribution and fusion of particles with heatingly mixing to control the particle shape, whereby toner particles are formed.

In the aggregation/fusion step, there may be added a surfactant to perform stable dispersion of the individual particles in a coagulation system. Such a surfactant is not specifically restricted and there may be employed commonly known surfactants. Examples of a suitable ionic surfactants include a sulfonate such as sodium dodecylbenzenesulfonate or sodium aryl alkyl polyether sulfonate; a sulfuric acid ester salt such as sodium dodecylsulfate, sodium tetradecylsulfate, sodium pentadecylsulfate or sodium octylsulfate; and a fatty acid salt such as sodium oleate, sodium laurate, sodium caprate, sodium caprylate, sodium caproate, potassium stearate, and calcium oleate. There may be used a nonionic surfactant such as a polyethylene oxide, polypropylene oxide, a combination of a polyethylene oxide and a polypropylene oxide, an ester of polyethylene glycol and a higher fatty acid, an alkylphenol polyethylene oxide, an ester of a higher fatty acid and polypropylene oxide, or sorbitan ester. The foregoing surfactants may be used singly or in their combination.

Flocculants in the aggregation/fusion step include, for example, monovalent, divalent or trivalent metal salts. Examples of a metal constituting a flocculant include an alkali metal such as lithium, sodium or potassium; an alkaline earth metal such magnesium, calcium, strontium or barium; and aluminum. Examples of a counter ion of the foregoing metals (that is, an anion forming a salt) include a chloride ion, bromide ion, iodide ion, carbonate ion and sulfate ion.

In the aggregation/fusion step, cross-linked acryl resin particles are added to the reaction system, preferably in such an amount that the content in the finally obtained toner particles falls within the range of not less than 1% and not more than 40% by mass. It is a concern that a content of less than 1% by mass does not achieve enhanced high temperature offset resistance and a content of more than 40% by mass retards the progress of fusion and results in an increased production load, and cannot achieve sufficient low-temperature fixability.

In the aggregation/fusion step, crystalline polyester resin particles are added to the reaction system, preferably in such an amount that the content in the finally obtained toner particles falls within the range of not less than 0.3% and not more than 39% by mass. It is concerned that a content of less than 0.3% by mass does not achieve sufficient low-temperature fixability and a content of more than 39% by mass results in deteriorated blocking resistance of a toner.

Further, in the aggregation/fusion step, non-crystalline polyester resin particles are added to the reaction system, preferably in such an amount that the content in the finally obtained toner particles falls within the range of not less than 15% and not more than 98% by mass. It is a concern that a content of less than 15% by mass leads to inferior charging property and blocking resistance, while a content of more than 98% by mass cannot achieve sufficient low temperature fixability.

Further, in the aggregation/fusion step, the ratio of crystalline polyester resin particle to non-crystalline polyester resin particle to be added to the reaction system is preferably within a range of 1:99 to 40:60 by mass, and more preferably 10:90 to 40:60 by mass. An excessive addition of crystalline polyester resin particles is a concern that it will be inferior in heat stability and an insufficient addition of crystalline polyester resin particles is concerned to render it difficult to achieve sufficient low temperature fixability of a toner.

Further, in the aggregation/fusion step, colorant particles are added to the reaction system, preferably in such an amount that the content falls within the range of 1 to 10% by mass of the finally obtained toner particles, and more preferably 2 to 8% by mass. It is a concern that a content of less than 1% by mass of the toner cannot achieve the desired coloring power, while a content of more than 10% by mass causes release of the colorant or adhesion of the colorant to a carrier, adversely affecting charging property.

In cases when introducing an internal additive such as a releasing agent or a charge controlling agent into toner particles, a dispersion of particles comprised of an internal additive alone is prepared prior to the aggregation/fusion step (2, and in the aggregation/fusion step (2), the thus prepared dispersion of internal additive particles is mixed together with a cross-linked acryloyl resin particle dispersion, a crystalline polyester resin particle dispersion and a non-crystalline polyester resin particle dispersion.

Further, in the step of preparation of a crystalline polyester resin particle dispersion (1-A), preparation of a non-crystalline polyester resin particle dispersion (1-B) or preparation of a crosslinked acryl resin particle dispersion (1-C), an internal additive is allowed to be mixedly present together with a non-crystalline polyester resin or a crystalline polyester resin at the molecular level, whereby the internal additive can be introduced into the interior of the toner particles.

It is preferred that, to cover toner particles in the course of the aggregation/fusion step (2), a dispersion of binder resin particles is further added and fusion is promoted to form a shell layer covering core particles formed through aggregation or aggregation/fusion. It is preferred to form a shell layer with a non-crystalline polyester resin. Namely, only non-crystalline polyester resin particles are added thereto to form a shell layer composed of a non-crystalline polyester resin to achieve enhancement of low temperature fixability and mechanical strength. Meanwhile, the shell layer may be formed by addition of non-crystalline polyester resin particles and cross-linked acryl resin particles to inhibit high temperature offset.

Releasing Agent:

Releasing agents usable in the present invention are not specifically limited and those which are commonly known are usable. Specific examples thereof include low molecular weight polyolefins such as polyethylene, polypropylene and polybutene; a synthetic polyester wax; natural plant waxes such as candelilla wax, carnauba wax, rice wax, haze wax, hohoba wax; petrolatum mineral wax such as montan wax, paraffin wax, microcrystalline wax and Fischer-Tropsch wax; and modified materials of the foregoing waxes.

Charge Controlling Agent:

A charge controlling agent usable in the present invention can employ various known compounds. A charge controlling agent is added preferably in an amount of 0.1 to 10 parts by mass, based on 100 parts by mass of finally obtained toner particles, and more preferably 0.5 to 5 parts by mass.

(3) Filtration/Washing Step:

In the step of filtration and washing, the thus obtained toner particle dispersion is cooled and the cooled dispersion is subjected to solid/liquid separation to filter of toner particles (filtration) and the thus filtered toner particles (which are cake-formed aggregates) are washed to remove adhered materials such as a surfactant (washing). Specific examples of a method for solid/liquid separation and washing include a centrifugal separation method, vacuum filtration using a Nutsche funnel or the like and filtration method employing a filter press, but are not limited to these.

(4) Drying Step:

In the step of drying, the thus washed toner particles are subjected to a drying treatment. Examples of a drying machine usable in the drying step include a spray dryer, a vacuum freeze dryer, a reduced-pressure dryer, a standing plate type dryer, a mobile plate type dryer, a fluidized-bed dryer, a rotary dryer, and an agitating dryer, but are not limited to these. The water content of the thus dried toner particles is preferably not more than 5% by mass, and more preferably, not more than 2% by mass.

The water content of toner particles is determined by the Karl Fischer's coulometric titration method. Specifically, using an automatic thermo-vaporizing moisture measurement system (AQS-724, produced by Hiranuma Sangyo Co., Ltd.) constituted of aquameter AO-6, AQI-601 (interface for AQ-6 and a heating vaporizer LE-24S, 0.5 g of toner particles, which were previously allowed to stand over 24 hours under an environment of 20° C. and 50% RH, is precisely weighed out and placed into a 20 ml glass sample tube and tightly stoppered by using Teflon-coated silicone rubber packing, and the content of water existing in such a tightly stoppered environment is measured under the following measurement conditions and using a reagent, as described below. Simultaneously, two tubes of an empty sample are measured for correction of the content of water existing in a tightly stoppered environment;

Sample heating temperature: 110° C.,

Sample heating time: 1 minute,

Nitrogen gas flow rate: 150 ml/min

Reagent: counter electrode liquid (cathode liquid); HYDRANAL®-Coulomat CGK generation liquid (anode liquid); HYDRANAL®-Coulomat AK.

Further, in cases when the thus dried particles are aggregated through a weak inter-particle attractive force to form aggregates, the aggregates may be subjected to a disintegrating treatment. A disintegrating treatment can be carried out by using a mechanical disintegrating apparatus such as a jet mill, a Henschel Mixer, a coffee mill, or a food processor.

(5) External Additive Addition Step:

The external additive addition step is one for addition of external additives such as a charge controlling agent, various inorganic particles, organic particles or a lubricant for the purpose of an improvement of flowability, electrostatic-charging property or an enhancement of cleaning property, which are conducted as needed. Devices used for addition of an external additive include, for example, a Turbula Mixer, a Henschel Mixer, a Nauta Mixer and a V-shape mixer. Inorganic particles preferably employ inorganic oxide particles such as silica, titania or alumina Such inorganic particles preferably are those which are previously subjected to a hydrophobilizing treatment by use of a silane coupling agent or a titanium coupling agent. An external additive is incorporated into a toner preferably in an amount of 0.1 to 5% by mass, and more preferably 0.5 to 4.0% by mass. Further, various external additives may be used in combination.

The production method described above makes it feasible to produce, with a lessened production load, a toner which can form an image of high quality, exhibits enhanced high temperature offset resistance as well as superior low temperature fixability, and enhanced mechanic strength.

Toner:

The toner of the present invention is one which is produced by the above-described method and specifically, it is a toner comprising toner particles containing a non-crystalline polyester resin, a crystalline polyester resin and a crosslinked acryl resin, and the acryl resin having a cross-link structure having a cross-link site derived from a crosslinking agent represented by the formula (1) described earlier.

The toner particles of the present invention, preferably exhibit a content of a THF-insoluble component derived from the binder resin of 1 to 50% by mass. The content of a THF-insoluble component derived from the binder resin of toner particles indicates a content of a cross-liked component of toner particles. It is a concern that a content of less than 1% by mass cannot achieve enhanced high temperature offset resistance and it is also a concern that, when the content is more than 50% by mass, the progress of fusion in the process of preparing toner particles becomes slower, leading to an increased production load.

The content of a THF-insoluble component derived from the binder resin of toner particles related to the present invention is determined in such a manner that a prescribed amount (approximately, 0.03 g) of a toner as a measurement sample is immersed in a prescribed amount (approximately, 100 ml) of THF over 20 hours and filtered with a wire-mesh of 120 mesh, and the mass of residual solids is measured and its percentage by mass is calculated, provided that in cases when the THF-insoluble component not derived from the binder (for example, a colorant or a releasing agent) is contained, the content of such a component is previously subtracted from the mass of the residual solid content.

Of the content of the THF-insoluble component derived from the binder resin of toner particles, the content of the component derived from an acryl resin is preferably from 1 to 100% by mass, and more preferably 50 to 99% by mass. The content of a component derived from an acryl resin of the THF-insoluble component indicates the content of cross-linking sites derived from a specific cross-linking agent, and when such a content is less than 1% by mass, it is a concern that the mechanical strength of the toner particles becomes insufficient.

Of the content of the THF-insoluble component derived from the binder resin, the content of a component derived from an acryl resin is measured by reactive pyrolysis-gas chromatography/mass spectrometry (reactive Py-GC/MS). Specifically, using tetramethylammonium hydroxide (TMAH) as a methylating agent, a pyrolysis apparatus, PY 2020D and SS-1010E (both of which are produced by Frontier Labo. Co.) are connected to a mass selection type detector gas chromatograph to perform reactive Py-GC/MS. There are, for example, cited pyrolysis conditions in which 0.1 mg of a toner is placed into a stainless steel sample vessel used for pyrolysis, 2 μL of a methylating agent is dropwise added thereto and pyrolysis is performed at a pyrolysis temperature of 400° C.

Glass Transition Temperature and Softening Point of Toner:

The toner of the present invention preferably exhibits a glass transition temperature (Tg) of 30 to 60° C. and more preferably, 35 to 54° C., and preferably, a softening point of 70 to 140° C. and more preferably, 80 to 137° C. The glass transition temperature (Tg) and the softening point are determined in the same manner, as afore-described, except that a toner is used as a sample.

Toner Particle Size:

The toner particles produced by the afore-described method preferably exhibit a particle size of 3 to 8 μm, in terms of volume-based median diameter. The toner particle size can be controlled by the coagulant concentration or an addition amount of an organic solvent, or the fusion time in the aggregation and fusion step and by the composition of a polyester resin. A 3-8 μm volume-based median diameter results in reduction of toner particles exhibiting increased adhesion which easily fly and adhere to a heating member to cause fixing offset, and also results in enhanced transfer efficiency, leading to enhanced halftone image quality and enhanced image quality of a fine line or a dot image.

The particle size distribution of toner particles of the present invention is preferably within a range of 16 to 35, expressed by exhibiting a coefficient of variation of particle size distribution (which is hereinafter also denoted simply as a CV value), and more preferably 18 to 22. The CV value is determined by the equation (x) described below:

$$\text{CV value (\%)}=[(\text{standard deviation})/(\text{arithmetic average particle size})]\times 100 \qquad \text{Equation (x)}$$

wherein the arithmetic average particle size is an average value of volume-based particles sizes of approximately 5,000 particles.

The volume-based particle size is measured by Coulter Multisizer III (produced by Beckman Coulter Corp.) connected to a computer system for data processing. Specifically, 0.02 g of a toner is treated with a 20 ml surfactant solution (in which a neutral detergent containing a surfactant component is diluted 10 times with pure water) and then subjected to ultrasonic dispersion for 1 min. to prepare a toner dispersion. The toner dispersion is introduced by a pipette into a beaker containing ISOTON II (produced by Beckman Coulter Co.), and placed in a sample stand until it reaches a measured concentration of 5 to 10%. Such a concentration makes it feasible to obtain reproducible measurement values. The analyzer count is set to 25000 particles and the aperture diameter is set to 50 μm. A measurement range of 1 to 30 μm is divided to 256 parts and the frequency of an individual part is calculated and the particle diameter at 50% of volume fraction integrated from the larger side (also denoted volume D 50% diameter) is defined as a volume-based median diameter.

Average Circularity Degree:

In a toner produced by the foregoing method, toner particles constituting the toner preferably exhibit an average circularity degree of 0.930 to 1.000 in terms of enhancement of transfer efficiency, and more preferably 0.945 to 0.995. An average circularity degree falling within a range of 0.930 to 1.000 results in an increased packing density of toner particles, leading to enhanced fixability and rendering it difficult to cause fixing offset. Further, the individual toner particles become difficult to fracture, resulting in a decrease in staining of a frictional charging member and leading to stabilized electrostatic chargeability of the toner.

The average circularity degree can be determined by using FPIA-2100 (produced by Sysmex Co., Ltd.). Specifically, toner particles are blended in an aqueous surfactant solution and dispersed using an ultrasonic homogenizer for 1 min. The measurement condition is set to HPF (high power focusing) mode and the measurement is carried out at an optimum concentration of the HPF detection number of 3000-10000. Reproducible data are obtained in such a range. The circularity degree is defined as below:

Circularity degree=(circumference length of a circle having an area equivalent to a projection of a particle)/(circumference length of a projection of a particle).

The average circularity degree is the sum of circularity degree values of total particles divided by the number of particles.

Developer:

The toner, as described above, may be used as a magnetic single-component developer containing a magnetic material or mixed with a carrier to be used as a two-component developer. In cases when using the toner of the present invention as a two-component developer, there are usable magnetic particles composed of commonly known materials, for example, a metal such as iron, ferrite or magnetite, or an alloy of such a metal and a metal such as aluminum or lead. Of these materials are preferred ferrite particles.

The volume-based median diameter of a carrier is preferably from 15 to 100 μm, and more preferably from 25 to 60 nm. The volume-based median diameter of a carrier can be measured by laser diffraction sensor HELOS (produced by SYMPATECS Co., Ltd.) which is installed with a wet disperser.

A carrier preferably employs a coated carrier in which the surface of a magnetic particle is coated with a covering agent such as a resin or a dispersion type carrier formed of a powdery magnetic material dispersed in a binder resin. Resins constituting such a resin coverage carrier are not specifically limited and examples thereof include an olefinic resin, a styrene resin, a styrene-acryl resin, a silicone resin, an ester resin and a fluorine-containing polymer resin. A resin constituting a resin dispersion type carrier is not specifically limited but can employ resins commonly known in the art, and examples thereof include an acryl resin, a styrene-acryl resin, a polyester resin, a fluorinated resin and a phenol resin.

Image Forming Method:

The toner, as described above, is suitable for an image forming method comprising a fixing step by a contact heating system. Specifically, in such a image forming method, an electrostatic latent image formed on an image support is developed with a developer to form a toner image, while electrostatically charging the developer in a developing device, the formed toner image is transferred onto a recording material, and then the toner image transferred onto the recording material is fixed to the recording material through a contact-heating system to obtain a visible image.

The toner, which exhibits enhanced mechanical strength, is also suitable for an image forming method comprising a developing step by high-speed development. The developing step by high-speed development refers to a developing step performing an output of at least 60 A4-sized sheets at a printing factor of 5%.

The toner, as described above, can basically form an image of enhanced image quality and achieves enhanced high temperature offset resistance and mechanical strength, while maintaining superior low-temperature fixability.

The reason for such a toner achieving enhanced mechanical strength is presumed to be that a binder resin contains a cross-linking site derived from a specific crosslinking agent, namely, a long chain portion of the specific crosslinking agent is introduced to the binder resin, whereby flexibility due to the long chain portion is displayed.

While the present invention has specifically been described in detail and with reference to specific embodiments thereof, it will be apparent that various changes and modifications can be made.

EXAMPLES

Synthesis of Non-Crystalline Polyester Resin (A)

Into a reaction vessel fitted with a stirrer, a nitrogen introducing tube, a temperature sensor and a fractionator were placed 4.2 parts by mass of fumaric acid, 78 parts by mass of terephthalic acid, 152 parts by mass of 2,2-bis(4-hydroxyphenyl)propane with 2 mole ethylene oxide adduct and 48 parts by mass of 48 parts by mass of 2,2-bis(4-hydroxyphenyl) propane with 2 mole ethylene oxide adduct. The temperature of the reaction system was raised to 190° C. over 1 hour and after confirming that the reaction system was being stirred homogeneously, $Ti(OBu)_4$ as a catalyst was added thereto in an amount of 0.006% by mass per total amount of polyvalent carboxylic acids. Further, while distilling off formed water, the temperature of the reaction system was further raised to 240° C. over 6 hours and the dehydrocondensation reaction continued over 6 hours to perform polymerization, while maintaining the temperature at 240° C., whereby a non-crystalline polyester resin (A) was obtained. The thus obtained non-crystalline polyester resin (A) exhibited a weight average molecular weight (Mw) of 2,700, a glass transition point (Tg) of 63° C. and a softening point of 95° C. The molecular weight, the glass transition temperature and the softening point of the non-crystalline polyester resin (A) were determined in the afore-described manner.

Preparation of Non-Crystalline Polyester Resin Particle Dispersion (A1):

Into a reaction vessel fitted with an anchor-blade providing stirring power were added methyl ethyl ketone and isopropyl alcohol. Thereafter, the foregoing non-crystalline polyester resin (A), which was coarsely crushed by a hammer mill, was gradually added thereto and dispersed with being dissolved or dispersed to obtain an oil phase. Subsequently, an aqueous diluted ammonia solution was dropwise added to the oil phase with stirring and the oil phase was dropwise added to deionized water to cause phase-inversed emulsification, thereafter, solvents were removed with evacuating by an evaporator to obtain a non-crystalline polyester resin particle dispersion. Further, deionized water was added to the dispersion so that the solid content of the dispersion reached 40% by mass, whereby a non-crystalline polyester resin particle dispersion (A1) was obtained.

The volume-based median diameter of non-crystalline polyester resin particles of the obtained dispersion (A) which was measured by an electrophoretic light-scattering photometer (ELS-800, produced by Otsuka Denshi Co., Ltd.) was 182 nm.

Synthesis of Crystalline Polyester Resin (B):

Into a reaction vessel fitted with a stirrer, a nitrogen introducing tube, a temperature sensor and a fractionator were placed 200 parts by mass of 1,10-dodecane diacid, as a polycarboxylic acid, and 140 parts by mass of 1,9-nonanediol as a polyvalent alcohol. The reaction mixture was heated to 190° C. over 1 hour and while homogeneously stirring the reaction mixture, $Ti(OBu)_4$ as a catalyst was added thereto in an amount of 0.006% by mass of the total amount of the polycarboxylic acid and the temperature of the reaction mixture was raised to 240° C. over 6 hours, while distilling off water. The dehydrocondensation reaction was continued over 6 hours to perform polymerization, while maintaining the temperature at 240° C., whereby a crystalline polyester resin (B) was obtained. The thus obtained crystalline polyester resin (B) exhibited a weight average molecular weight (Mw) of 2,900 and a melting point of 65° C. The molecular weight and the melting point of the crystalline polyester resin (B) were determined in the same manner as described above.

Preparation of Crystalline Polyester Resin Particle Dispersion (B1):

A crystalline polyester resin particle dispersion (B1) having a 40% solid content (crystalline polyester resin particles) was prepared in the same manner as the foregoing non-crystalline polyester resin particle dispersion (A1), except that non-crystalline polyester resin (A) was replaced by the crystalline polyester resin (B).

The volume-based median diameter of non-crystalline polyester resin particles of the obtained dispersion (B) which was measured by an electrophoretic light-scattering photometer (ELS-800, produced by Otsuka Denshi Co., Ltd.) was 207 nm.

Preparation of Cross-Linked Acryl Resin Particle Dispersion (C1):

Into a separable flask fitted with a stirrer, a temperature sensor, a condenser and a nitrogen-introducing device was a surfactant solution of 2 g of an anionic surfactant (sodium dodecylbenzenesulfonate) dissolved in 740 g of distilled water and the internal temperature was raised to 80° C., while stirring at a rate of 230 rpm under a nitrogen gas stream. Further, the composition described below was mixed and dissolved with heating at 80° C. to prepare a monomer solution.

| | |
|---|---|
| Styrene | 295 parts by mass |
| Acrylic acid | 52 parts by mass |
| 1,9-Nonanediol acrylate | 40 parts by mass |
| n-Octylmercaptan | 0.8 part by mass |

These two solutions were mixed and dispersed in a mechanical disperser fitted with a circulation path. Subsequently, a solution of 3.3 g of a polymerization initiator (potassium persulfate or denoted as KPS) dissolved in 350 g of deionized water was added thereto and heated at 80° C. over 3 hours with stirring to prepare a dispersion of cross-linked acryl resin particles. To the dispersion was added deionized water so that solid content (cross-linked acryl resin particles) was 20% by mass, whereby a cross-linked acryl resin particle dispersion (C1) was obtained.

In the thus obtained cross-linked acryl resin particle dispersion (C1), the volume-based median diameter of cross-linked acryl resin particles, which was measured by an electrophoretic light scattering photometer (ELS, produced by Otsuka Denshi Co., Ltd.), was 125 nm. Further, the cross-linked acryl resin particle dispersion (C1) was subjected to solid-liquid separation and the softening point of the resin was measured and proved to be 161.3° C. Of the thus separated resin particles, the weight average molecular weight (Mw) of a tetrahydrofuran-soluble component (or THF-soluble component) was proved to be 160,300. A THF-insoluble component (gel component) accounted for 20.2% by mass of thea total solid amount of cross-linked acryl resin particles.

Preparation of Magenta Colorant Particle Dispersion:

Into 195 parts by mass of deionized water was added and dissolved 5 parts by mass of an anionic surfactant (NEOGEN RK, produced by Daiich Kogyo Seiyaku Co., Ltd.) and further thereto, 50 parts by mass of C.I. Pigment Red 122 (produced by Clariant Japan Co.) and dispersed over 10 minutes by a homogenizer (ULTRA-TURRAX, produced by IKA Co.) to obtain a magenta colorant particle dispersion (M) having a 10% by mass solid content. In the thus obtained magenta colorant particle dispersion (M), the volume-based median diameter of magenta colorant particles, which was measured by an electrophoretic light scattering photometer (ELS, produced by Otsuka Denshi Co., Ltd.), was 185 nm.

Preparation of Releasing Agent Particle Dispersion:

Into 195 parts by mass of deionized water were added 5 parts by mass of an anionic surfactant (NEOGEN RK, produced by Daiich Kogyo Seiyaku Co., Ltd.) and 50 parts by mass of a paraffin wax (FNP 92, melting point of 91° C., produced by Nippon Seiro Co., Ltd.) and heated to 60° C. and dispersed by a homogenizer (ULTRA-TURRAX, produced by IKA Co.) and was further dispersed by using a pressure discharge type Gaulin homogenizer to obtain a releasing agent particle dispersion (W) having a 20% by mass solid content (releasing agent particles). In the thus obtained releasing agent particle dispersion (W), the volume-based median diameter of releasing agent particles, which was measured by an electrophoretic light scattering photometer (ELS, produced by Otsuka Denshi Co., Ltd.), was 170 nm.

Preparation of Toner (1):

The composition described below was added into a reaction vessel fitted with a temperature sensor, a condenser tube, a nitrogen introducing device and a stirrer and stirred. The temperature within the vessel was adjusted to 30° C. and then, the solution was adjusted to a pH of 3.0 with an aqueous 10% by mass nitric acid solution.

| | |
|---|---|
| Noncrystalline polyester resin particle dispersion (A1) | 1,195 parts by mass |
| Crystalline polyester resin particle dispersion (B1) | 190 parts by mass |
| Cross-linked acryl resin particle dispersion (C1) | 735 parts by mass |
| Magenta colorant particle dispersion (M) | 200 parts by mass |
| Releasing agent particle dispersion (W) | 380 parts by mass |
| Anionic surfactant (NEOGEN RK) | 8 parts by mass |
| Deionized water | 300 parts by mass |

Subsequently, the mixture was heated to 47° C. with dispersing by a homogenizer (ULTRA-TURRAX, produced by IKA Co.) and when the volume-based median diameter ($D_{50}$) of aggregated particles reached 6.5 μm with measuring particle sizes by MULTI-SIZER (produced by Beckmann Coulter Corp.), the pH of the reaction mixture was adjusted to 9.0 with an aqueous 5% sodium hydroxide solution. Further, after stirring at a liquid temperature of 90° C. over 3 hours, the reaction mixture was cooled to 30° C. at a rate of 6° C./min and the pH was adjusted to 2.0 with hydrochloric acid, and then, stirring was stopped, whereby toner particles were prepared. The thus prepared toner particles were subjected to liquid-solid separation, repeatedly washed with 15 L deionized water four times, and dried by 40° C. air to obtain toner (1×) comprised of toner particles (1). The toner particles (1) of the toner (1×) exhibited a volume-based median diameter ($D_{50}$) of 6.55 μm and an average circularity degree of 0.964.

To the toner (1×) were added a hydrophobic silica (number average primary particle size of 12 nm and a hydrophobicity degree of 68) in an amount of 1% of the toner and a hydrophobic titanium oxide (number average primary particle size of 20 nm and a hydrophobicity degree of 63) in an amount of 1% of the toner, and mixed by Henschel mixer (produced by Mitsui Miike Kakoki Co., Ltd.) and then, coarse particles were removed by using a sieve of a 45 μm aperture, whereby toner (1) was obtained.

It was proved that the content of a THF-insoluble component derived from a binder resin of the thus obtained toner (1) was 7.1% by mass, of which the content of the component derived from an acryl resin was 50.9% by mass.

Preparation of Cross-Linked Acryl Resin Particle Dispersion (C2):

A cross-linked acryl resin particle dispersion (C2) was prepared in the same manner as the foregoing cross-linked acryl resin particle dispersion (C1), except that 1,9-nonanediol diacrylate was replaced by 1,10-nonanediol diacrylate.

The thus prepared cross-linked acryl resin particle dispersion (C2) was measured in the same manner as above and it was proved that the cross-linked acryl resin particles exhibited a volume-based median diameter of 143 nm and a softening point of 154.8° C., and the weight average molecular weight (Mw) of a THF-soluble component was 155,200 and the content of a THF-insoluble component was 14.5% by mass of the total solids.

Preparation of Cross-Linked Acryl Resin Particle Dispersion (C3):

A cross-linked acryl resin particle dispersion (C3) was prepared in the same manner as the foregoing cross-linked acryl resin particle dispersion (C1), except that 40 parts by mass of 1,9-nonanediol diacrylate was replaced by 30 parts by mass of propoxylated Bisphenol A diacrylate (PO: 3 mol).

The thus prepared cross-linked acryl resin particle dispersion (C3) was measured in the same manner as above and it was proved that the cross-linked acryl resin particles exhibited a volume-based median diameter of 118 nm and a softening point of 135.2° C., and the weight average molecular weight (Mw) of a THF-soluble component was 158,100 and the content of a THF-insoluble component was 7.7% by mass of the total solids.

Preparation of Cross-Linked Acryl Resin Particle Dispersion (C4):

A cross-linked acryl resin particle dispersion (C4) was prepared in the same manner as the cross-linked acryl resin particle dispersion (C1), except that 40 parts by mass of 1,9-nonanediol diacrylate was replaced by 30 parts by mass of 1,9-nonanediol dimethacrylate.

The thus prepared cross-linked acryl resin particle dispersion (C4) was measured in the same manner as above and it was proved that the cross-linked acryl resin particles exhibited a volume-based median diameter of 131 ran and a softening point of 148.8° C., and the weight average molecular weight (Mw) of a THF-soluble component was 161,200 and the content of a THF-insoluble component was 9.8% by mass of total solids.

Preparation of Cross-Linked Acryl Resin Particle Dispersion (C5):

A cross-linked acryl resin particle dispersion (C5) was prepared in the same manner as the cross-linked acryl resin particle dispersion (C1), except that the amount of sodium dodecylbenzenesulfonate (DBS) was changed to 4 g and 40 parts by mass of 1,9-nonanediol diacrylate was replaced by 48 parts by mass of ethoxylated polypropylene glycol (#700) dimethacrylate (PO: 12 mol, EO: 6 mol).

The thus prepared cross-linked acryl resin particle dispersion (C5) was measured in the same manner as above and it was proved that the cross-linked acryl resin particles exhibited a volume-based median diameter of 85 nm and a softening point of 188.4° C., and the weight average molecular weight (Mw) of the THF-soluble component was 150,500 and the content of the THF-insoluble component was 45.1% by mass of total solids.

Preparation of Cross-Linked Acryl Resin Particle Dispersion (C6):

A cross-linked acryl resin particle dispersion (C6) was prepared in the same manner as the cross-linked acryl resin particle dispersion (C5), except that ethoxylated polypropylene glycol (#700) dimethacrylate (PO: 12 mol, EO: 6 mol) was replaced by 47 parts by mass ethoxylated Bisphenol A diacrylate (EO: 10 mol %).

The thus prepared cross-linked acryl resin particle dispersion (C6) was measured in the same manner as above and it was proved that the cross-linked acryl resin particles exhibited a volume-based median diameter of 80 nm and a softening point of 167.0° C., and the weight average molecular weight (Mw) of the THF-soluble component was 143,300 and the content of the THF-insoluble component was 45.7% by mass of total solids.

Preparation of Cross-Linked Acryl Resin Particle Dispersion (C7):

A cross-linked acryl resin particle dispersion (C7) was prepared in the same manner as the cross-linked acryl resin particle dispersion (C1), except the amount of sodium dodecylbenzenesulfonate (DBS) was changed to 1.2 g and 40 parts by mass of 1,9-nonanediol diacrylate was replaced by 43 parts by mass of 2-hydroxy-3-acryloyloxypropyl methacrylate.

The thus prepared cross-linked acryl resin particle dispersion (C7) was measured in the same manner as above and it was proved that the cross-linked acryl resin particles exhibited a volume-based median diameter of 175 nm and a softening point of 152.3° C., and the weight average molecular weight (Mw) of a THF-soluble component was 143,300 and the content of a THF-insoluble component was 45.7% by mass of total solids.

Preparation of Cross-Linked Acryl Resin Particle Dispersion (C8):

A cross-linked acryl resin particle dispersion (C8) was prepared in the same manner as the cross-linked acryl resin particle dispersion (C1), except the amount of sodium dodecylbenzenesulfonate (DBS) was changed to 1.0 g and 40 parts by mass of 1,9-nonanediol diacrylate was replaced by 7 parts by mass 1,6-hexanediol diacrylate.

The thus prepared cross-linked acryl resin particle dispersion (C8) was measured in the same manner as above and it was proved that the cross-linked acryl resin particles exhibited a volume-based median diameter of 193 nm and a softening point of 112.0° C., and the weight average molecular weight (Mw) of a THF-soluble component was 123,300 and the content of a THF-insoluble component was 0.7% by mass of total solids.

Preparation of Cross-Linked Acryl Resin Particle Dispersion (C9):

A cross-linked acryl resin particle dispersion (C9) was prepared in the same manner as the cross-linked acryl resin particle dispersion (C1), except 1,9-nonanediol diacrylate was replaced by divinylbenzene.

The thus prepared cross-linked acryl resin particle dispersion (C9) was measured in the same manner as above and it was proved that the cross-linked acryl resin particles exhibited a volume-based median diameter of 138 nm and a softening point of 140.3° C., and the weight average molecular weight (Mw) of the THF-soluble component was 164,300 and the content of the THF-insoluble component was 7.1% by mass of total solids.

Preparation of Toner (2):

Toner (2) was prepared in the same manner as the toner (1), except that 735 parts by mass of cross-linked acryl resin particle dispersion (C1) was replaced by 840 parts by mass of cross-linked acryl resin particle dispersion (C2).

It was proved that the content of a THF-insoluble component derived from a binder resin of the thus obtained toner (2) was 5.4% by mass, of which the content of a component derived from an acryl resin was 53.7% by mass.

Preparation of Toner (3):

Toner (3) was prepared in the same manner as the toner (1), except that 735 parts by mass of cross-linked acryl resin particle dispersion (C1) was replaced by 460 parts by mass of cross-linked amyl resin particle dispersion (C3).

It was proved that the content of a THF-insoluble component derived from a binder resin of the thus obtained toner (3) was 4.0% by mass, of which the content of a component derived from an acryl resin was 23.5% by mass.

Preparation of Toner (4):

Toner (4) was prepared in the same manner as the toner (3), except that cross-linked acryl resin particle dispersion (C3) was replaced by cross-linked acryl resin particle dispersion (C4).

It was proved that the content of a THF-insoluble component derived from a binder resin of the thus obtained toner (4) was 4.1% by mass, of which the content of a component derived from an acryl resin was 28.2% by mass.

Preparation of Toner (5):

The composition described below was added into a reaction vessel fitted with a temperature sensor, a condenser tube, a nitrogen introducing device and a stirrer and then stirred. The temperature within the vessel was adjusted to 30° C. and then, the solution was adjusted to a pH of 3.0 with an aqueous 10% by mass nitric acid solution.

| | | |
|---|---|---|
| Noncrystalline polyester resin particle dispersion (A1) | 1,015 | parts by mass |
| Crystalline polyester resin particle dispersion (B1) | 190 | parts by mass |
| Cross-linked acryl resin particle dispersion (C5) | 2,230 | parts by mass |
| Magenta colorant particle dispersion (M) | 200 | parts by mass |
| Releasing agent particle dispersion (W) | 380 | parts by mass |
| Anionic surfactant (NEOGEN RK) | 8 | parts by mass |
| Deionized water | 300 | parts by mass |

Subsequently, the mixture was heated to 47° C. with dispersing by a homogenizer (ULTRA-TURRAX, produced by IKA Co.) and when the volume-based median diameter ($D_{50}$) of aggregated particles reached 6.3 μm with measuring particle sizes by MULTI-SIZER (produced by Beckmann Coulter Corp.), 180 parts by mass of non-crystalline polyester resin particle dispersion (A1) was added and non-crystalline polyester resin particles were allowed to adhere and fuse to the aggregated particles with stirring and heating to form a shell. Thereafter, the pH of the reaction mixture was adjusted to 9.0 with an aqueous 5% sodium hydroxide solution. Further, after stirring at a liquid temperature of 90° C. over 3 hours, the reaction mixture was cooled to 30° C. at a rate of 6° C./min and the pH was adjusted to 2.0 with hydrochloric acid, and then, stirring was stopped, whereby toner particles were prepared. The thus prepared toner particles were subjected to liquid-solid separation, repeatedly washed with 15 L deionized water four times, and dried by 40° C. air to obtain toner (5×) comprised of toner particles (5). The toner particles (5) of the toner (5×) exhibited a volume-based median diameter ($D_{50}$) of 6.61 μm and an average circularity degree of 0.963.

It was proved that the content of a THF-insoluble component derived from a binder resin of the thus obtained toner (5) was 19.2% by mass, of which the content of a component derived from an acryl resin was 81.4% by mass.

Preparation of Toner (6):

Toner (6) was prepared in the same manner as the toner (5), except that 2230 parts by mass of cross-linked acryl resin particle dispersion (C5) was replaced by 460 parts by mass of cross-linked acryl resin particle dispersion (C4).

It was proved that the content of a THF-insoluble component derived from a binder resin of the thus obtained toner (6) was 4.6% by mass, of which the content of a component derived from an acryl resin was 23.4% by mass.

Preparation of Toner (7):

Toner (7) was prepared in the same manner as the toner (1), except that 735 parts by mass of cross-linked acryl resin particle dispersion (C1) was replaced by 1800 parts by mass of cross-linked acryl resin particle dispersion (C6).

It was proved that the content of a THF-insoluble component derived from a binder resin of the thus obtained toner (7) was 18.8% by mass, of which the content of a component derived from an acryl resin was 86.0% by mass.

Preparation of Toner (8):

Toner (8) was prepared in the same manner as the toner (1), except that 735 parts by mass of cross-linked acryl resin particle dispersion (C1) was replaced by 375 parts by mass of cross-linked acryl resin particle dispersion (C7).

It was proved that the content of a THF-insoluble component derived from a binder resin of the thus obtained toner (8) was 5.3% by mass, of which the content of a component derived from an acryl resin was 48.1% by mass.

Preparation of Toner (9):

Toner (9) was prepared in the same manner as the toner (8), except that the cross-linked acryl resin particle dispersion (C7) was replaced by the cross-linked acryl resin particle dispersion (C8).

It was proved that the content of a THF-insoluble component derived from a binder resin of the thus obtained toner (9) was 2.3% by mass, of which the content of a component derived from an acryl resin was 2.7% by mass.

Preparation of Toner (10):

Toner (10) was prepared in the same manner as the toner (1), except that 735 parts by mass of cross-linked acryl resin particle dispersion (C1) was replaced by 2230 parts by mass of cross-linked acryl resin particle dispersion (C5).

It was proved that the content of a THF-insoluble component derived from a binder resin of the thus obtained toner (10) was 21.5% by mass, of which the content of a component derived from an acryl resin was 83.8% by mass.

Preparation of Toner (11):

Toner (11) was prepared in the same manner as the toner (3), except that the cross-linked acryl resin particle dispersion (C3) was replaced by the cross-linked acryl resin particle dispersion (C9).

It was proved that the content of a THF-insoluble component derived from a binder resin of the thus obtained toner (11) was 3.8% by mass, of which the content of a component derived from an acryl resin was 22.9% by mass.

Of the foregoing toners, toners (1) to (10) are the ones related to the present invention and toner (11) is one used for comparison.

Preparation of Developer:

Each of the thus prepared toners (1) to (11) was mixed with a ferrite carrier covered with a silicone resin and exhibiting a volume average particle size of 60 μm so that the concentration of the toner was 6% by mass, whereby developers (1) to (11) were prepared.

Evaluation 1:

The thus prepared developers were evaluated with respect to high and low temperature offset resistance. Specifically, using a commercially available hybrid full-color printer (bizhub PRO C6501, produced by Konica Minolta Business Technologies Inc.) in which a fixing device was modified so that the surface temperature of a fixing heat roller was variable in the range of 100 to 210° C., while longitudinally feeding A4-size plain paper (weight: 80 g/m$^2$), fixing experiments in which a 5 mm wide solid image elongated vertical to the transporting direction was fixed at a position of 200 mm from the top of the paper, were repeated with increasing the fixing temperature at intervals of 5° C., such as 100° C., 105° C., . . . .

In the fixing experiments, the fixing temperature at which an image stain due to low temperature offset or an image stain due to high temperature offset was visibly observed, was defined as the temperature of low temperature offset or the temperature of high temperature offset. Results thereof are shown in Table 2.

Evaluation 2:

Using the foregoing printer, fixing experiments in which a solid image with a toner adhesion amount of 11 mg/10 cm$^2$ was fixed, were repeated with increasing the fixing temperature at intervals of 5° C., such as 100° C., 105° C., . . . . Prints obtained in fixing experiments at the respective temperatures were each folded by a folder with applying a given load to the solid image and then, compressed air of 0.35 MPa was blasted thereto and folds were ranked in five ranks, based on the criteria described below. The fixing temperature at which "rank 3" resulted in the fixing experiment was defined as a fixing temperature. Evaluation results are shown in Table 2.

Rank 5: no fold was observed,

Rank 4: peeling was partially observed along a fold,

Rank 3: peeling in a fine line form was observed along folds,

Rank 2: peeling in a thick line form was observed along folds,

Rank 1: extensive peeling was observed.

Evaluation 3:

Toners (1) to (11) were evaluated with respect to mechanical strength. Using a micro-compression tester (MCT-W 201, produced by Shimazu Seisakusho Co., Ltd.), the 10% deformation strength of a toner particle was determined in a compression test mode. Specifically, under controlled measurement conditions of a temperature of 21 to 23° C. and a relative humidity of 45 to 65% RH, ten toner particles falling within the range of number average particle size±20% were measured with respect to a compression load causing a 10% deformation quantity, of which an arithmetic average value of six measurement values except the largest two values and the smallest two values was defined as a 10% deformation strength. In the present invention, a 10% deformation strength falling within a range of 9 to 50 MPa was judged to be acceptable in practice.

TABLE 1

| Cross-linked Acryl Resin Particle Dispersion | Cross-linking Agent: Compound | Cross-linking Agent: No. of Carbon Atoms | Physical Property: Volume-based Median Diameter (μm) | Physical Property: Weight Average Molecular Weight (Mw) | Physical Property: Softening Point (° C.) | Physical Property: THF-insoluble Component (% by mass) |
|---|---|---|---|---|---|---|
| 1 | 1,9-nonanediol diacrelate | 9 | 125 | 160,300 | 161.3 | 20.2 |
| 2 | 1,10-decanediol diacrelate | 10 | 143 | 155,200 | 154.8 | 14.5 |
| 3 | propoxylated Bisphenol A diacrelate (PO: 3 mol %) | 24 | 118 | 158,100 | 135.2 | 7.7 |
| 4 | 1,9-nonanediol dimethacrelate | 9 | 131 | 161,200 | 148.8 | 9.8 |
| 5 | ethoxylated polypropylene glycol #700 dimethacrylate (PO: 12 mol, EO: 6 mol) | 48 | 85 | 150,500 | 178.4 | 45.1 |
| 6 | ethoxylated Bisphenol A diacrelate (EO: 10 mol) | 35 | 80 | 143,300 | 167.0 | 45.7 |
| 7 | 2-hydroxy-3-acryloyloxypropyl methacrelate | 3 | 175 | 87,300 | 152.3 | 24.9 |
| 8 | 1,6-hexanediol diacrelate | 6 | 193 | 123,300 | 112.0 | 0.7 |
| 9 | divinylbenzene | — | 138 | 164,300 | 140.3 | 7.1 |

TABLE 2

| Example No. | Toner No. | Cross-linking Agent: Compound | Cross-linking Agent: No. of Carbon Atoms | Evaluation Result: High Temperature Offset Resistance: Occurrence Temperature of High Temperature Offset (° C.) | Evaluation Result: Low Temperature Fixability: Occurrence Temperature of Low Temperature Offset (° C.) | Evaluation Result: Low Temperature Fixability: Fixing Temperature Lower Limit (° C.) | Evaluation Result: Mechanical Strength: 10% Deformation Strength (MPa) |
|---|---|---|---|---|---|---|---|
| 1 | 1 | 1,9-nonanediol diacrelate | 9 | >210* | 105 | 110 | 32.2 |
| 2 | 2 | 1,10-decanediol diacrelate | 10 | >210 | 105 | 110 | 26.5 |
| 3 | 3 | propoxylated Bisphenol A diacrelate (PO: 3 mol %) | 24 | 200 | 105 | 110 | 22.6 |
| 4 | 4 | 1,9-nonanediol dimethacrelate | 9 | 200 | 110 | 115 | 23.2 |
| 5 | 5 | ethoxylated polypropylene glycol #700 dimethacrylate (PO: 12 mol, EO: 6 mol) | 48 | 200 | 110 | 115 | 14.4 |
| 6 | 6 | 1,9-nonanediol dimethacrelate | 9 | 200 | 105 | 110 | 28.3 |
| 7 | 7 | ethoxylated Bisphenol A diacrelate (EO: 10 mol) | 35 | >210 | 105 | 110 | 30.6 |
| 8 | 8 | 2-hydroxy-3-acryloyloxypropyl methacrelate | 3 | 195 | 105 | 110 | 9.7 |
| 9 | 9 | 1,6-hexanediol diacrelate | 6 | 195 | 105 | 110 | 21.2 |
| 10 | 10 | ethoxylated polypropylene glycol #700 dimethacrylate (PO: 12 mol, EO: 6 mol) | 48 | 200 | 115 | 120 | 9.9 |
| Comp. 1 | 11 | divinylbenzene | — | 185 | 105 | 110 | 8.5 |

*more than 210° C.

What is claimed is:

1. A toner comprising toner particles containing a binder resin comprising a crystalline polyester resin, a non-crystalline polyester resin and an acryl resin having a cross-link structure, and the acryl resin having a cross-link structure has a cross-link site derived from crosslinking agent represented by the following formula (1):

$$CH_2{=}CR^1{-}C({=}O)O{-}Z{-}OC({=}O){-}CR^2{=}CH_2 \qquad \text{Formula (1)}$$

wherein $R^1$ and $R^2$ are each a hydrogen atom or an alkyl group of 1 to 3 carbon atoms, and Z is a hydrocarbon group of 2 to 90 carbon atoms, provided that the hydrocarbon group may include an ether linkage, an ester linkage, a heterocyclic ring or a substituent.

2. The toner of claim 1, wherein in the formula (1), Z is a divalent hydrocarbon group.

3. The toner of claim 1, wherein in the formula (1), $R^1$ and $R^2$ are each a hydrogen atom or a methyl group and Z is a hydrocarbon group of 6 to 40 carbon atoms.

4. The toner of claim 1, wherein in the formula (1), Z is a straight chain alkylene group of 6 to 12 carbon atoms.

5. The toner of claim 1, wherein in the formula (1), Z is an ethoxylated Bisphenol A, propoxylated Bisphenol A or propoxylated-ethoxylated Bisphenol A.

6. The toner of claim 1, wherein the toner particles contain a tetrahydrofuran-insoluble component derived from the binder resin in an amount of 1 to 50% by mass.

7. The toner of claim 6, wherein the tetrahydrofuran-insoluble component derived from the binder resin contains a component derived from the acryl resin in an amount of 1 to 100% by mass.

8. The toner of claim 6, wherein the tetrahydrofuran-insoluble component derived. from the binder resin contains a component derived from the acryl resin in an amount of 50 to 99% by mass.

9. The toner of claim 1, wherein the toner particles contain a tetrahydrofuran-insoluble component derived from the binder resin in an amount of 5 to 20% by mass.

10. The toner of claim 1, wherein the non-crystalline polyester resin exhibits a softening point of 80 to 100° C. and the acryl resin exhibits a softening point of 110 to 180° C.

11. The toner of claim 1, wherein the toner particles have a core/shell structure and a core contains the binder resin comprising the non-crystalline polyester resin, the crystalline polyester resin and the acryl resin having a cross-link structure, and a shell contains a binder resin comprising the non-polyester resin.

12. The toner of claim 1, wherein the crystalline polyester resin exhibits a weight average molecular weight of 1,000 to 50,000 and the non-crystalline polyester resin exhibits a weight average molecular weight of 3,000 to 100,000.

13. The toner of claim 1, wherein the crystalline polyester resin exhibits a weight average molecular weight of 2,000 to 30,000 and the non-crystalline polyester resin exhibits a weight average molecular weight of 4,000 to 70,000.

14. A method of producing a toner comprising toner particles containing a binder resin comprising a non-crystalline polyester resin, a crystalline polyester resin and an acryl resin having a cross-link structure, the method comprising the steps of:

performing polymerization with dispersing an oil-phase solution containing a polymerizable acrylic monomer and a cross-linking agent in an aqueous medium to form cross-linked acryl resin particles comprising an acryl resin having a cross-link structure, and allowing non-crystalline polyester resin particles comprising a non-crystalline polyester resin, crystalline polyester resin particles comprising crystalline polyester resin and the cross-linked acryl resin particles to be aggregated and fused in an aqueous medium to form toner particles, wherein the cross-linking agent to form the cross-linked acryl resin particles is a compound represented by the following formula (1)

$$CH_2{=}CR^1{-}C({=}O)O{-}Z{-}OC({=}O){-}CR^2{=}CH_2 \qquad \text{Formula (1)}$$

wherein $R^1$ and $R^2$ are each a hydrogen atom or an alkyl group of 1 to 3 carbon atoms, and Z is a hydrocarbon group of 2 to 90 carbon atoms, provided that the hydrocarbon group may include an ether linkage, an ester linkage, a heterocyclic ring or a substituent.

15. The method of claim 14, wherein in the formula (1), Z is a divalent hydrocarbon group.

16. The method of claim 14, wherein the non-crystalline polyester resin exhibits a softening point of 80 to 100° C. and the acryl resin exhibits a softening point of 110 to 180° C.

17. The method of claim 14, wherein the cross-linked acryl resin particles exhibit a volume-based median diameter of 80 to 200 nm.

* * * * *